US006000793A

United States Patent [19]

Inamoto

[11] Patent Number: 6,000,793

[45] Date of Patent: Dec. 14, 1999

[54] IMAGE FORMING PROCESS AND PRINTED ARTICLE

[75] Inventor: Tadayoshi Inamoto, Hachioji, Japan

[73] Assignee: Canon Kabushiki Kaisha, Tokyo, Japan

[21] Appl. No.: 08/813,955

[22] Filed: Mar. 3, 1997

[30] Foreign Application Priority Data

Mar. 6, 1996 [JP] Japan ..... 8-075361
Feb. 4, 1997 [JP] Japan ..... 9-034289

[51] Int. Cl.[6] ..... B41M 7/00; B41J 2/01

[52] U.S. Cl. ..... 347/101; 347/102; 347/103

[58] Field of Search ..... 347/101, 103, 347/102; 399/342

[56] References Cited

U.S. PATENT DOCUMENTS

| | | | |
|---|---|---|---|
| 4,833,116 | 5/1989 | Yamori et al. | 503/200 |
| 4,880,695 | 11/1989 | Rudd et al. | 428/341 |
| 5,718,793 | 2/1998 | Inamoto et al. | 156/235 |

FOREIGN PATENT DOCUMENTS

| | | |
|---|---|---|
| 47-51734 | 12/1972 | Japan . |
| 51-116287 | 10/1976 | Japan . |
| 52-05843 | 1/1977 | Japan . |
| 60-08959 | 5/1978 | Japan . |
| 54-59936 | 5/1979 | Japan . |
| 5-309956 | 11/1993 | Japan . |
| 6-143792 | 5/1994 | Japan . |

*Primary Examiner*—John Barlow
*Assistant Examiner*—Christina Annick
*Attorney, Agent, or Firm*—Fitzpatrick, Cella, Harper & Scinto

[57] ABSTRACT

Disclosed herein is a process for forming an image on a base material, which comprises the steps of (1) ejecting a liquid ink containing a disperse dye as droplets according to predetermined information to form an image on an ink-absorbent sheet, thereby obtaining an image-printing sheet; (2) bringing the image-printing sheet into close contact with a base material having a dye-receiving layer capable of receiving the disperse dye on its surface and high heat resistance of at least 150° C., heating the printing sheet to transfer and diffuse the disperse dye on the image-printing sheet to and into the dye-receiving layer, and then separating the image-printing sheet from the base material, thereby obtaining an intermediate printed article; and (3) applying an aqueous coating fluid containing a substantially transparent resin to the transferred image on the intermediate printed article to provide a first overcoat layer and then applying a substantially transparent resin to the first overcoat layer to provide a second overcoat layer having a pencil hardness of 2H or harder as determined by the pencil scratch test in accordance with JIS K 5400.

27 Claims, No Drawings

IMAGE FORMING PROCESS AND PRINTED ARTICLE

BACKGROUND OF THE INVENTION

1. Field of the Invention

The present invention relates to an image forming process and a printed article, and particularly to a process for forming an image having excellent image properties on a surface of a base material which has a high heat resistance of at least 150° C., but has no ink absorbency.

2. Related Background Art

As processes for forming images on base materials such as ceramics such as earthenware, porcelain and stoneware, glass, plastics, and metals, which are not absorbent of liquid ink components, there have heretofore been a direct printing process in which printing is performed directly on these base materials, and a process of bonding a synthetic resin film, on which an image has been printed in advance, to the surfaces of these base materials to form an image thereon.

The former printing process is generally performed by gravure printing or offset printing. However, printing presses used in these printing processes are expensive, and the processes are required to fabricate a plate according to the desired pattern. Therefore, it has been hard to say that this process is suitable for small-quantity printing. A process in which an image is directly formed on a base material by an ink-jet recording system without fabricating a plate is also performed in part. Under the circumstances, this process is however applied only to printing of lot numbers on products and simple characters up to the present, and the color is also limited to a single color. When it is intended to print a color image by an ink-jet recording system on the surface of a base material having no ink absorbency, overlapped inks remain as ink droplets on the base material because the base material has no ink absorbency, so that fine color mixing is prevented, and boundaries between different colors become indistinct. In addition, the scratch resistance and wear resistance of the formed image are insufficient because printing is conducted directly on the base material. Namely, it has been difficult to form any bright color image excellent in scratch resistance and wear resistance directly on the surface of a base material having no ink absorbency by the ink-jet recording system.

On the other hand, the latter process is a process of bonding an image-printed synthetic resin film to the surface of a base material having no ink absorbency to form an image thereon, but offers a problem of adhesion between the image-printed film and the base material. Troubles such as peeling of the film have been often caused.

As a process for solving these problems, Japanese Patent Publication No. 47-51734 discloses a process in which an ink-receiving layer composed of a synthetic resin film is formed on the surface of a base material having no ink absorbency in advance, an image-printing sheet, on which an image containing a sublimate dye (disperse dye) has been formed, is laid on the synthetic resin film, and the printing sheet is then heated to sublimate the dye so as to transfer only the dye to the synthetic resin film on the base material, thereby forming an image on the resin film. Besides, as a process for forming an image containing a sublimate dye on a printing sheet, it is disclosed in Japanese Patent Publication No. 60-8959 to use an ink-jet recording system.

Specific examples of such receiving layers for disperse dyes as described above are disclosed in Japanese Patent Application Laid-Open Nos. 52-5843, 5-309956 and 6-143792. According to Japanese Patent Application Laid-Open No. 52-5843, however, fiber is intended for a base material, and so the principal object in view is to keep the hand feeling of a finished textile good. Therefore, any receiving layer having high mechanical strength such as high scratch resistance cannot be obtained. In Japanese Patent Application Laid-Open Nos. 5-309956 and 6-143792, it is described to use, as materials for the formation of receiving layers, polyester resin compositions having resistance to various stains which form the cause of irregularity of images formed. These resin compositions are believed to be excellent as materials for the formation of receiving layers for sublimate-transfer image-receiving paper. The sublimate-transfer image-receiving paper is generally used in recording systems such as a sublimate transfer system and a melt transfer system and attaches importance to recording speed. Therefore, as sublimate dyes used, those low in sublimation temperature are in use. On the other hand, when an image containing a disperse dye formed on an image-printing sheet is transferred to heat-resistant base materials such as pottery, glass, plastics and metals, it is desirable that the transfer be performed at a temperature as high as possible to effectively diffuse the disperse dye into the receiving layer. Namely, when the sublimate transfer is performed under such conditions, it is possible to form a bright and high-color density image, which conforms to the image on the image-printing sheet, on the surfaces of the base materials such as pottery and glass. When the transfer of the image is performed under such conditions, however, there has been problems that the receiving layer composed of the polyester resin composition as described above is softened, so that a situation that a mark of the image-printing sheet is left on the base materials in the form of irregularities, or that the image-printing sheet is not separated from the base materials in the worst case may be brought on.

When the use situation of image-printed articles obtained in the above described manner is considered, severe criteria as to properties of the images such as mechanical strength, light fastness, stain resistance and chemical resistance are not very required of displays and the like used indoors. When the printed articles are intended for building materials which are used outdoors, for example, external wall materials and floor covering materials, considerably severe criteria as to the properties of the images are required of them. Even when the printed articles are used indoors, it is necessary to take the prevention against the generation of mildew on the printed articles into consideration in the case where they are intended to use in places easy to generate dew condensation, such as bathroom and wall covering materials.

Further, there is described in Japanese Patent Application Laid-Open No. 51-116287 a process to add a new function to a printed article after conducting textile printing by sublimate transfer to a receiving layer. In this method, a flameproofing treatment is conducted by applying an overcoat layer to polyester fibers printed by the sublimate transfer. However, Japanese Patent Application Laid-Open No. 51-116287 does not describe anything about the improvement in mechanical strength, light fastness, stains resistance and chemical resistance. As materials for the formation of the overcoat layer, those containing a non-aqueous solvent in plenty are generally often used because of their good properties. When the liquid overcoat materials containing such a solvent in plenty are used, however, a disperse dye penetrated into the receiving layer has slightly exuded in some cases. Although the amount of the dye exuded is slight, it is conspicuous at the contour part of an image when the background of the image is white. Therefore, there has been a problem that a clearness of the image has been impaired.

SUMMARY OF THE INVENTION

It is therefore an object of the present invention to provide an image forming process which permits the formation of a clear image without fabricating a printing plate on a base material which is not absorbent of liquid components and has a high heat resistance, and an image-forming material and a printed article obtained by using such a process.

The above object can be achieve by the present invention described below.

According to the present invention, there is thus provided a process for forming an image on a base material, which comprises the steps of:

(1) ejecting a liquid ink containing a disperse dye as droplets according to predetermined information to form an image on an ink-absorbent sheet, thereby obtaining an image-printing sheet;

(2) bringing the image-printing sheet into close contact with a base material having a dye-receiving layer capable of receiving the disperse dye on its surface and a high heat resistance of at least 150° C., heating the image-printing sheet to transfer and diffuse the disperse dye on the image-printing sheet to and into the dye-receiving layer, and then separating the image-printing sheet from the base material, thereby obtaining an intermediate printed article; and (3) applying an aqueous coating fluid containing a substantially transparent resin to the transferred image on the intermediate printed article to provide a first overcoat layer and then applying a substantially transparent resin to the first overcoat layer to provide a second overcoat layer having a pencil hardness of 2H or harder as determined by the pencil scratch test in accordance with JIS K 5400.

According to the present invention, there is also provided a printed article formed by the process described above.

DESCRIPTION OF THE PREFERRED EMBODIMENTS

In the present invention, a printing sheet containing an image formed with a disperse dye is brought into close contact with a dye-receiving layer provided on a surface of a base material having no ink-absorbency and a high heat resistance of at least 150° C. and heated to transfer and diffuse the disperse dye, which forms the image, to and into the dye-receiving layer. Thereafter, the image-printing sheet is separated from the base material to form an intermediate printed article, and an overcoat layer is then formed on the intermediate printed article. The overcoat layer is composed of a two-layer structure of first and second layers, thereby permitting the formation of a clear and high-color density image conforming to the original image and having excellent scratch resistance (scuff resistance), wear resistance and the like on the surface of the base material having no ink-absorbency. More specifically, bleed of the resultant image occurs due to the exudation of disperse dyes, when a coating fluid containing a solvent in plenty is used to form an overcoat layer. Such exudation is suppressed by the first overcoat layer (intermediate layer) composed of a water-soluble resin or a transparent resin of an aqueous emulsion. On the first overcoat layer, the second overcoat layer containing, for example, an ultraviolet absorbent and a mildew-proofing agent therein is provided, thereby obtaining a printed article on which an image having far excellent mechanical strength, light fastness, stain resistance, chemical resistance and mildew-proofing property has been formed on a base material having no ink-absorbency selected from the group consisting of ceramics such as earthenware, porcelain and stoneware, glass, plastics, and metals without impairing the clearness of images. According to the constitution of the present invention, further, the dye-receiving layer formed in advance on the base material having no ink-absorbency can be composed in view of the transferability of image in the first place, so that a beautiful printed article having a clear and high-color density image can be obtained.

The present invention will hereinafter be described in more detail with reference to the preferred embodiments.

The image forming process according to the present invention comprises a printing sheet-forming step of forming an image-printing sheet having an image formed with a disperse dye; a step of bringing the image-printing sheet into close contact with the surface of a dye-receiving layer capable of receiving the disperse dye provided on the surface of a base material having a high heat resistance of at least 150° C., heating the image-printing sheet to transfer and diffuse the disperse dye on the image-printing sheet to and into the dye-receiving layer, and then separating the image-printing sheet from the base material, thereby obtaining an intermediate printed article; and a step of applying a substantially transparent resin to the resultant intermediate printed article to form an overcoat layer. The feature of the present invention resides in that the step of forming the overcoat layer includes applying an aqueous coating fluid containing a substantially transparent resin to the intermediate printed article to provide a first overcoat layer and then applying a substantially transparent resin to the first overcoat layer to laminate a second overcoat layer having a pencil hardness of 2H or harder, thereby forming a laminated overcoat layer having a two-layer structure.

Disperse dyes contained in inks used in the printing sheet-forming step in the present invention are materials known per se in the art, refer to water-insoluble or hardly water-soluble dyes used widely in dyeing of fibers in a dispersed state and include azo, anthraquinone and other dyes from the viewpoint of chemical structure. These disperse dyes have no hydrophilic groups such as sulfonic and carboxylic groups in their structures, each have a molecular weight within a certain range and are used in the form of an aqueous dispersion. They are mainly used in dyeing synthetic fibers such as polyester and acetate by heating them at a temperature of from 80 to 250° C. after applying them in the state of the aqueous dispersions to the fibers or fabrics or during their application. In the present invention, all the conventionally known disperse dyes may be used. However, preferable disperse dyes in the present invention are as follows.

Examples of disperse dyes preferably used in the present invention include:

C.I. Disperse Yellow 5, 42, 56, 64, 76, 79, 83, 100, 124, 140, 160, 162, 163, 164, 165, 186, 192 and 224;

C.I. Disperse Orange 13, 29, 30, 31, 33, 43, 49, 50, 55, 61, 73, 78 and 119;

C.I. Disperse Red 43, 54, 56, 72, 73, 76, 88, 91, 92, 93, 103, 111, 113, 126, 127, 128, 135, 143, 145, 152, 153, 154, 164, 181, 188, 189, 192, 203, 205, 206, 207, 221, 224, 225, 227, 257, 258, 288 and 296;

C.I. Disperse Violet 27, 35, 38, 46, 52 and 56;

C.I. Disperse Brown 1 and 9;

C.I. Disperse Blue 54, 60, 73, 87, 94, 113, 128, 139, 142, 143, 146, 148, 149, 158, 167, 176, 183, 186, 187, 197, 198, 201, 205, 207, 211, 214, 224, 225, 257, 259, 267, 268, 270 and 301;

Kayacelon Red E-GL (trade name); and

Kayacelon Blue E-TB (trade name).

Among the conventionally-known dispersed dyes as described above, the disperse dyes most preferably used in the image forming process according to the present invention are those which have a comparatively high molecular weight and a transfer temperature of at least about 180° C. under normal pressure. The reason for this is that the sublimation and transfer at such a high temperature permits effective diffusion of the disperse dyes into the receiving layer and hence the formation of a clear and high-color density image on the surface of a base material such as ceramic or glass becomes possible. When multicolor printing of at least two colors is performed in accordance with the image forming process of the present invention, it is also preferable that all disperse dyes to be used be selected in such a manner that their transfer temperatures are within the transfer temperature range as described above with a view toward making a degree of coloring upon the transfer even. Incidentally, the measurement of the temperature at which a disperse dye effectively sublimates and transfers may be carried out by a thermal analytical means such as T.G., D.T.A. or D.S.C., or the method prescribed in JIS L 0879. The selection of the preferred disperse dyes can be easily made by those skilled in the art.

Inks used in the present invention comprise such a disperse dye as described above and a liquid medium dispersing or dissolving the disperse dye therein. As the liquid medium used at this time, any of liquid media used routinely in general dyeing and liquid media used routinely in ink-jet recording inks may be used. For example, water and/or water-soluble organic solvents are preferably used. Specific examples of preferable water-soluble organic solvents usable in the present invention include alkyl alcohols having 1 to 4 carbon atoms, such as methyl alcohol, ethyl alcohol, isopropyl alcohol, n-propyl alcohol, n-butyl alcohol, sec-butyl alcohol, tert-butyl alcohol and isobutyl alcohol; amides such as dimethylformamide and dimethylacetamide; ketones and keto-alcohols such as acetone and diacetone alcohol; ethers such as tetrahydrofuran and dioxane; polyalkylene glycols such as polyethylene glycol and polypropylene glycol; alkylene glycols the alkylene moiety of which has 2 to 6 carbon atoms, such as ethylene glycol, propylene glycol, butylene glycol, triethylene glycol, hexylene glycol and diethylene glycol; thiodiglycol; 1,2,6-hexanetriol; glycerol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; N-methyl-2-pyrrolidone; 1,3-dimethyl-2-imidazolidinone; and the like.

The liquid media as described above may be used either singly or in any combination thereof. However, the most preferred composition of the liquid medium is a mixed solvent comprising water and at least one organic solvent which comprises at least one water-soluble, high-boiling solvent, for example, a polyhydric alcohol such as ethylene glycol, propylene glycol or glycerol. These liquid media may preferably be used in such an amount that the content of the disperse dye amounts to a range of the order of from 0.1 to 15% by weight upon the preparation of an ink composition.

Although the composition of the inks used in the printing sheet-forming step in the image forming process of the present invention is as described above, conventionally-known various dispersants, surfactants and viscosity modifiers may be further added as needed. Examples of the dispersants or surfactants which may be added to the inks as needed include anionic dispersants or surfactants such as fatty acid salts, salts of alkylsulfates, alkylbenzenesulfonates, alkylnaphthalene-sulfonates, dialkylsulfosuccinates and alkylphosphates, naphthalene-sulfonic acid-formalin condensates, and polyoxyethylene alkylsulfates; and nonionic dispersants or surfactants such as polyoxyethylene alkylphenyl ethers, polyoxyethylene fatty acid esters, sorbitan fatty acid esters, polyoxyethylene sorbitan fatty acid esters, polyoxyethylene alkylamines, glycerol esters of fatty acid and oxyethylene-oxypropylene block copolymers.

As the viscosity modifiers, for example, mainly water-soluble natural or synthetic polymers such as carboxymethyl cellulose, sodium polyacrylate, polyvinyl pyrrolidone, gum arabic and starch are preferably used. The viscosity of the ink used in the present invention, which are obtained with or without these viscosity modifiers, is preferably 50 cP or lower, more preferably within a range of from 1 to 10 cP.

In the case where an ink-jet recording system of a type that ink is charged electrostatically is used in the printing sheet-forming step in the image forming process of the present invention, it is preferable to add a resistivity regulative agent composed of an inorganic salt, for example, lithium chloride, ammonium chloride, sodium chloride or the like upon the preparation of the ink.

In addition to the above three additives, for example, an antifoaming agent, a penetrant, a mildew-proofing agent, a pH adjuster, etc. may be suitably added to the inks used in the present invention as needed.

In the printing sheet-forming step in the image forming process of the present invention, it is preferable to use inks of such a composition as described above to form an image on a medium, which is absorbent of liquid ink, by an ink-jet recording method. Therefore, the inks used in the present invention may preferably be prepared by the same process as that used in the ink-jet recording inks conventionally used. More specifically, it is common to mix the above-described components, grind the mixture by the conventionally-known grinding means, for example, a ball mill, a sand mill or a speed line mill, optionally control the concentration of the mixture with a liquid medium and finally adjust its pH to 4 to 10. The particle diameter of the disperse dye is generally controlled to about 30 $\mu$m or smaller, preferably about 20 $\mu$m or smaller. If the particle diameter is too great, problems such as clogging at an orifice may be caused upon ink-jet printing in some cases. When a liquid medium dissolving the disperse dye therein is selected as the liquid medium, an ink usable in the present invention can be obtained by simple dissolving operation such as heating.

As described above, an ink-jet recording method is preferably used in the formation of an image in the printing sheet-forming step in the present invention. The use of the ink-jet recording method makes an expensive printing press, which is required in the conventional printing process, useless, and so a printing plate is also unnecessary. This brings about the following advantages: An image-printed article can be provided more cheaply, and delivery time of the product can also be shortened to an extremely great extent.

As the ink-jet recording method usable in the present invention, any system may be used so far as it is a system that an ink-jet recording ink of such a constitution as described above can be ejected as droplets according to predetermined information to form an image on a printing sheet. Typical examples of such systems are described in, for example, IEEE Trans Actions on Industry Applications, Vol. JA-13, No. 1 (the February and March, 1977 issue) and Nikkei Electronics, No. 305 (the Dec. 6, 1982 issue). The systems described therein are suitable for the ink-jet recording method used in the present invention. Some of them will be described. First, there is mentioned an ink-jet recording method of an electrostatic attraction system. In this system, there are two methods in one of which a strong electric field is applied between a nozzle and an accelerating electrode placed several millimeters ahead the nozzle to successively draw an ink in the form of droplets out of the nozzle, and information signals are applied to deflecting electrodes while the drown ink droplets are flown between the deflecting electrodes, thereby conducting recording, and in the other of which ink droplets are ejected according to information signals without deflecting the ink droplets. Both methods are effective for application to the ink-jet printing method used in the present invention.

As the second system, there is an ink-jet recording method of a system in which a high pressure is applied to an ink by a small-sized pump, and a nozzle is mechanically vibrated by a quartz oscillator or the like, thereby forcedly ejecting ink droplets. According to this system, the ejected ink droplets are electrically charged according to information signals at the same time as the ejection. The charged ink droplets are deflected according to the degree of charge while they pass through between deflecting electrodes. As another system making good use of this system, there is also a system called a microdot ink-jet system. In this system, an ink pressure and exciting conditions are kept at optimum values within certain ranges, thereby ejecting two kinds of ink droplets of large and small sizes from an orifice. Of these ink droplets, only the ink droplets of the small size are used in recording. This system features that a group of minute ink droplets can be ejected even from an ordinary wide orifice.

As the third system, there is an ink-jet recording method of a piezoelectric system. This system uses, as a means for pressurizing an ink, a piezoelectric element instead of mechanical means such as a pump used in other systems. More specifically, electric signals are applied to the piezoelectric element to cause mechanical displacement, thereby applying a pressure to an ink to eject the ink from an orifice.

As the system preferably used in the present invention, there is an ink-jet recording method described in Japanese Patent Application Laid-Open No. 54-59936. In this ink-jet system, an ink undergoes a rapid volumetric change by an action of thermal energy applied to the ink by rapidly heating a heating element, thereby ejecting the ink out of an orifice. In this system, the formation of the heating element and a groove of the orifice is made by a photolithography, which is performed in a production of semiconductors and the like, upon the production of an ink-jet head used. Therefore, the high-density mounting of nozzle and the formation of a multi-nozzle are easily performed, and an apparatus of such a system can be produced inexpensively. This ink-jet system is hence most suitable for the method used in the present invention.

In the image forming process of the present invention, the disperse dye-containing liquid ink ejected by the ink-jet recording method as described above is received on a printing sheet having no ink-absorbency to obtain an image-printing sheet on which an image of the disperse dye has been temporarily formed. As a result, there can be avoided disadvantages incurred by direct formation of images on a base material having a poor ink-absorbency, as follows:

First, when an image is directly formed on a base material by the ink-jet recording method, ink droplets formed on the base material aggregate each other if a base material having no ink-absorbency is used as the base material, so that any beautiful image cannot be formed. This problem is serious when an image is formed using two or more inks of different colors because defective coloring and bleeding at boundaries between different colors occur. Second, a disperse dye remaining on the surface of the base material after the transfer of the ink by heating must be washed and removed.

As the printing sheet used in the formation of the image with the disperse dye in the image forming process of the present invention, any sheet generally used in ink-jet recording methods may be used. As preferable examples of the sheet, may be mentioned those comprising, as a main component, cellulose, which are called plain paper. It goes without saying that those provided with a coating layer for controlling an ink absorbency, such as glossy paper and OHP, may also be used. However, the greatest care must be taken in using them because the coating layer may come to adhere to the base material due to heating upon transfer of the disperse dye, or the transfer of the disperse dye to the base material may be deteriorated.

The dye-receiving layer, which is formed on the surface of the base material having no ink-absorbency in the image forming process of the present invention and can receive the disperse dye, will now be described.

In the present invention, as described above, the surface characteristics of the final image-printed article are given by the overcoat layer which will be described subsequently. In the present invention, therefore, the materials for the formation of the dye-receiving layer can be selected in view of the transferability of the disperse dye in the first place. In the present invention, however, it should be avoided to use, as a material for the formation of the dye-receiving layer, such a resin as a press mark of the image-printing sheet is left on the receiving layer when the transfer is conducted by the close contact under heat, and the dye-receiving layer adheres to the image-printing sheet to fail to separate them from each other. It is therefore preferable to select the materials for the dye-receiving layer so as to provide a pencil hardness of H or harder as determined by the pencil scratch test in accordance with JIS K 5400.

Specific examples of materials for the formation of such a dye-receiving layer include alkyd resins obtained from a polybasic acid (for example, azelaic acid, chlorendic acid, succinic acid, trimellitic acid, o-phthalic acid, isophthalic acid, terephthalic acid, maleic acid, fumaric acid, adipic acid, sebacic acid or the like), a polyhydric alcohol (for example, α-methyl-glucoside, dipentaerythritol, glycerol, glycols, trimethylolmethane, trimethylolpropane, tripentaerythritol or sorbitol) and a fatty acid; silicone alkyd resins obtained by copolymerizing an alkyd resin with a silicone intermediate such as siloxane; amino resins obtained by reacting formaldehyde with urea or melamine, such as urea-formaldehyde resins and melamine-formaldehyde resins; epoxy resins crosslinked by an amino resin, phenol resin, amine, polyamide, isocyanate or the like; and resins such as polyester resins, unsaturated polyester resins, silicone resins, urethane resins, polyamide resins, polyimide resins and fluororesins. Resins such as acrylic resins obtained by polymerization or copolymerization of an acrylic or methacrylic ester may also be used. It goes without saying that mixtures and reaction products of these resins may also be included.

Among these resins, the urethane resins, which are reaction products of an isocyanate compound with a polyhydroxy compound or an amino group-containing compound, are mentioned as the most preferable resins. Specific examples of the isocyanate compound include aromatic isocyanates such as 2,4-toluylene diisocyanate, 2,6-toluylene diisocyanate, m-phenylene diisocyanate, p-phenylene diisocyanate, 2-chloro-1,4-phenylene diisocyanate, 1-chloro-2,4-phenylene diisocyanate, 1,5-naphthylene diisocyanate and 4,4'-diphenylmethane diisocyanate. Aliphatic and alicyclic polyisocyanates may also be used in the present invention. Specific examples thereof include hexamethylene diisocyanate, hexamethylene triisocyanate, isophorone diisocyanate, etc. Modified products and derivatives of these isocyanates may also be preferably used.

Examples of the polyhydroxy compound include polyether polyols, polyester polyols, acrylic polyols, phenol resin polyols, epoxy polyols, polyester polyether polyols, carbonate polyols, etc.

The reaction products of these compounds are generally colorless and transparent and easily provided with a dye-receiving layer having a pencil hardness of H or harder. Therefore, they are suitable for use in the formation of the dye-receiving layer used in the present invention. In the case of a reaction using the isocyanate compound, however, it must be avoided to mix water except for the case where water is used with particular intent because carbon dioxide is generated by its reaction with water. The same may be said of carboxyl group-containing compounds.

It is also effective to add a silane coupling agent to the dye-receiving layer as needed. As the effect of the silane coupling agent added, it is expectable to improve the adhesion between the base material and the resin as generally said. In the system using the isocyanate compound, a coupling agent is preferred, because the water content therein can be reduced by hydrolysis, and the hydroxyl group formed by the hydrolysis reacts with the isocyanate, whereby a dye-receiving layer having higher mechanical strength can be formed.

The amount of the silane coupling agent to be used is of the order of from 0.1 to 30% by weight based on the total weight of resin. If the amount of the silane coupling agent is less than 0.1% by weight, the effect of the addition cannot be exhibited. On the other hand, any amount exceeding 30% by weight results in a dye-receiving layer which tends to become brittle and also deteriorated in adhesion to the base material.

Specific examples of such a silane coupling agent include β-(3,4-epoxycyclohexyl)ethyltrimethoxysilane, γ-glycidoxypropyltrimethoxysilane, γ-mercaptopropyltrimethoxysilane, γ-mercaptopropylmethyldimethoxysilane, methyltrimethoxysilane, dimethyldimethoxysilane, methyltriethoxysilane, phenyltrimethoxysilane, vinyltrimethoxysilane, vinyltriethoxysilane,γ-methacryloxypropyltrimethoxysilane and γ-aminopropyltriethoxysilane.

As a method of coating the base material such as earthenware with the resin as described above to form the dye-receiving layer, the resin may be melted at a high temperature and directly applied so far as it is thermoplastic. However, precursor unreacted compounds of a resin to be coated, or their dilute solution, emulsion or colloid suspension in a solvent is generally coated by any of various processes such as spray coating, curtain coating, dip coating, wire bar coating, applicator coating, spin coating, roll coating, electrodeposition coating and brush coating. Thereafter, the coated base material is dried to remove the solvent, and a cure reaction is optionally performed, whereby a dye-receiving layer can be formed.

When an isocyanate compound is used to form the dye-receiving layer, the removal of the solvent by drying and cure reaction under heat may preferably be performed at two steps. Water, which is contained as an impurity, is removed together with the solvent by first heating at a relatively low temperature, after which the reaction is completed by second heating at a high temperature. In particular, when the coating is performed by the spray coating, there is a possibility that the temperature of the resin may be lowered by rapid vaporization of the solvent upon the coating, and water in air may be entrained, thereby adversely affecting the reaction. Therefore, this two-step heating is particularly effective. The first heating is preferably conducted under conditions of 100° C. or lower for from 5 minutes to 2 hours, while the second heating is preferably performed under conditions of from 100 to 250° C. for from 5 minutes to 3 hours.

Any material may be used as the base material on which the dye-receiving layer is to be formed so far as it has heat resistance of at least 150° C. For example, a material selected from ceramics such as earthenware, porcelain and stoneware, glass, plastics, and metals and having heat resistance of at least 150° C. is used as the base material. Namely, these materials have no ink-absorbency, and it is hence difficult to directly form an image on the surfaces of the base materials by an ink-jet printing process. On the other hand, any base material having a heat resistance lower than 150° C. is required to conduct sublimation and transfer of the disperse dye at a low temperature, and so it is difficult to obtain a clear image.

A step of transferring and diffusing the disperse dye from the image-printing sheet, on which an image has been formed with the disperse dye-containing ink described above, to and into the dye-receiving layer formed of the above-described materials will now be described. In this step, the image-printing sheet is brought into close contact with the dye-receiving layer on the surface of the base material and then heated to transfer and diffuse the disperse dye on the image-printing sheet to and into the dye-receiving layer on the surface of the base material. Thereafter, the image-printing sheet is separated from the base material to obtain an intermediate printed article.

The first importance in this step is to keep the image-printing sheet in close contact with the surface (i.e., the dye-receiving layer) of the base material. They are generally brought into contact with each other under a pressure of the order of from 0.1 to 5 kg/cm$^2$ using a pressure source such as spring or high-pressure air.

Second, it is effective to preheat the base material with a view toward shortening a treating time and obtaining an even temperature distribution. Finally, the image-printing sheet and the dye-receiving layer are heated at a temperature of 150 to 250° C. for from several seconds to several minutes while keeping them in close contact with each other. These conditions may be suitably determined from the ranges of the above-described conditions taking consideration of the heat resistance of the base material, the sublimating tendency of the disperse dye and the heat resistance of the dye-receiving layer. If the transfer temperature is low, or the heating time is short, the disperse dye is not fully transferred and diffused from the image-printing sheet to and into the dye-receiving layer, resulting in only an image low in color density. If the transfer temperature is raised than the step needs, or the heating time is prolonged than the step needs on the other hand, the disperse dye is decomposed or vaporized out of the dye-receiving layer, resulting in only a faded image.

After the transfer of the disperse dye as described above, the heating and pressurization are completed, and the image-printing sheet is separated from the base material, thereby obtaining the intermediate printed article on which the intended image has been formed. The intermediate printed article itself fully functions as a display. However, satisfactory image properties cannot be always achieved when it is intended for use under severe conditions in the open air, bathroom or the like.

Therefore, an overcoat layer is further provided on the intermediate printed article in the image forming process of the present invention. The feature of the present invention resides in that the overcoat layer is composed of two layers of a first overcoat layer and a second overcoat layer. First, the first overcoat layer is provided on the intermediate printed article for suppressing the exudation of the disperse dye. The second overcoat layer is further provided on the first overcoat layer serving as an intermediate layer to impart properties such as light fastness and mildew-proofing property to the resulting printed article. More specifically, it is considered that when an aqueous coating fluid composed of, for example, an aqueous solution or emulsion of a resin using water as a main medium is used to form an overcoat layer for suppressing the exudation of the disperse dye, the exudation of the disperse dye is prevented, and so a clear image can be obtained. However, such a resin has poor compatibility with additives, in particular, ultraviolet absorbents, so that these additives cannot be incorporated into the resin, resulting in a failure in obtaining an image-printed article having excellent light fastness. Therefore, the first overcoat layer is formed with such a resin as described above, and the second overcoat layer is laminated on the first overcoat layer. In the second overcoat layer, additives such as an ultraviolet absorbent and a mildew-proofing agent are contained, thereby satisfying properties such as light fastness and mildew-proofing property.

Materials for the formation of the overcoat layers will hereinafter be described. In the present invention, it is preferable to use, as a material for the formation of the first overcoat layer, an aqueous solution or emulsion of a resin using water as a main medium. Examples of resins applied to the aqueous solution of the resin using water as the main medium include water-soluble resins such as poly(meth) acrylic acid and salts thereof, polyvinyl alcohol, water-soluble cellulose derivatives, carboxymethyl cellulose, starch, polyacrylamide, polyvinyl pyrrolidone, acrylic acid-vinyl alcohol copolymers, pectin, glue, casein, polyethylene oxide and poly(vinyl methyl ether).

Besides, examples of resins applied to the aqueous emulsion of the resin using water as the main medium include water-dispersible resins such as poly(meth)acrylic acid type resins, (meth)acrylate type resins, styrene-butadiene type resins, acrylonitrile-butadiene type resins, vinyl acetate type resins and vinyl chloride type resins. Examples of products of these resins include Voncoat Series 3990, 2310, 6938, 6731, EC-818, EC-819, 3980, 3985 and 3986 (all, products of Dainippon Ink & Chemicals, Incorporated); Hytec S Series S-3111, S-3121, S-3125, S-3128 and S-3129 (all, products of Toho Chemical Industry Co., Ltd.); Jurymer AT Series AT-210, AT-510, AT-515 and AT-613, and Jurymer ET Series ET-410, ET-530 and ET-533 (all, products of Nihon Junyaku Co., Ltd.); Polytron Series U4431, U4510 and U4630 (all, products of Asashi Chemical Industry Co., Ltd.); PVC Latex Series Zeon 150x15, 351 and 576 (all, products of Nippon Zeon Co., Ltd.); Primal Series AC-55, AC-261, AC 630, AC-2000, E-2438, E-1895, HG-56, TL-5 and E-1630 (all, products of Rohm & Haas Co.); and Polysol Series SH-502, HR-G and AP-50 (all, products of Showa Highpolymer Co., Ltd.).

As materials for the formation of the first overcoat layer, water-soluble monomers, oligomers and polymers which are cured by exposure to radiation having activation energy may also be used. Examples of such materials include (meth) acrylates of polyhydric alcohols and their alkylene oxide adducts, such as 1,6-hexanediol diacrylate, trimethylolpropane triacrylate, Photomer 4061-SN, Nopcomer 4270 and Nopcomer 4510 (all, products of San Nopco Limited), and NK Ester A-200, NK Ester A-400, NK Ester A-600 and NK Ester A-1000 (all, products of Shin-Nakamura Chemical Co., Ltd.); and (meth)acrylates of products obtained by adding glycidyl ether to a polyhydric alcohol, such as Denacol Acrylate DA314, Denacol Acrylate DA832, Denacol Acrylate DA851, Denacol Acrylate DA911 and Denacol Acrylate DA920 (all, products of Nagase Chemicals, Ltd.). When these materials are used, it is necessary to conduct a curing treatment. Although no curing agent is especially required if the curing is conducted by electron beams, it is necessary to add a photo-curing agent to such a material in advance if the curing is conducted by ultraviolet rays. Examples of photo-curing agents usable at this time and particularly suitable for use in an aqueous system include Irgacure 2959, Irgacure 500 and Irgacure 184 (all, products of CIBA-GEIGY (Japan) Limited).

The materials for the formation of the first overcoat layer described above are preferably colorless and transparent so as not to impair the image of the intermediate printed article when laminated with the second overcoat layer which will be described subsequently. More specifically, it is preferable to limit rise in optical density after the application of the first and second overcoat layers to 0.5 or lower in a coating thickness described below. Although necessary transparency varies according to the pattern of the intermediate printed article, it is unavoidable except for a special intention to give a feeling of deteriorated image quality since an image is colored or is felt to be opaque, when the rise in optical density exceeds 0.5.

As a method of forming the first overcoat layer, generally a precursor unreacted compound of a resin to be applied or a coating fluid in the form of its dilute solution, emulsion or colloid suspension in a solvent is applied by a process such as spray coating, curtain coating, dip coating, wire bar coating, applicator coating, spin coating, roll coating, electrodeposition coating or brush coating to form a coating film, and the coating film thus formed is then dried to remove the solvent, and optionally subjected to a cure reaction, thereby forming the first overcoat layer.

The coating thickness of the first overcoat layer thus formed is preferably within a range of from 0.1 to 5 $\mu$m in terms of the thickness after the drying or curing. If the coating thickness is thinner than 0.1 $\mu$m, it is difficult to form a complete film, so that frequency of occurrence in defective coating becomes high. More specifically, the first overcoat layer becomes liable to produce pinholes due to irregularities of the surface of the base material and influence of adhered foreign matter. When the second overcoat layer is laminated thereon, therefore, the disperse dye dispersed and diffused into the dye-receiving layer on the base material may possibly exude through the pinholes due to the action of a solvent in a coating fluid for forming the second overcoat layer. If the coating thickness of the first overcoat layer exceeds 5 $\mu$m on the other hand, the materials for the formation of the first overcoat layer are used more than the layer needs, leading to an economical loss. In addition, there is a great possibility that rise in optical density and deterioration of mechanical properties may be caused. Therefore, such a too thin or thick coating thickness is not preferable.

When the first overcoat layer is formed, cissing of the coating fluid may occur according to its compatibility with the dye-receiving layer serving as an undercoating on the base material. In order to prevent the cissing, it is effective to subject the surface of the dye-receiving layer to a cleaning treatment prior to the formation of the first overcoat layer. As an example of a method for the cleaning treatment suitably used at this time, may be mentioned a method in which the surface of the dye-receiving layer on the base material is cleaned with oxygen plasma or ozone generated by ultraviolet-light irradiation in an oxygen-containing gas. When the coating fluid is applied to the intermediate printed article after conducting such a cleaning treatment, a first overcoat layer composed of an even thin film can be formed without causing the cissing of the coating fluid.

In the present invention, the second overcoat layer is provided on the first overcoat layer formed in the above-described manner to form a laminated overcoat layer composed of two layers. As the materials for the formation of the second overcoat layer, materials, which are colorless and transparent when laminated on the first overcoat layer, are used so as not to impair the image of the intermediate printed article as described above. The second overcoat layer is required to have a certain measure of mechanical strength because it makes up the top layer on the base material. In order to enhance the mechanical strength of the second overcoat layer, it is preferable to use materials to give a pencil hardness of 2H or harder, more preferably 4H or harder as determined by the pencil scratch test in accordance with JIS K 5400. If the surface hardness of this degree can be achieved, the resulting printed article can be used even in the outdoor application with little problem.

Example of the materials for the formation of the second overcoat layer, which can form a film having the above-described properties, include alkyd resins obtained from a polybasic acid (for example, azelaic acid, chlorendic acid, succinic acid, trimellitic acid, o-phthalic acid, isophthalic acid, terephthalic acid, maleic acid, fumaric acid, adipic acid, sebacic acid or the like), a polyhydric alcohol (for example, α-methyl-glucoside, dipentaerythritol, glycerol, glycols, trimethylolmethane, trimethylolpropane, tripentaerythritol or sorbitol) and a fatty acid; silicone alkyd resins obtained by copolymerizing an alkyd resin with a silicone intermediate such as siloxane; amino resins obtained by reacting formaldehyde with urea or melamine, such as urea-formaldehyde resins and melamine-formaldehyde resins; epoxy resins crosslinked by an amino resin, phenol resin, amine, polyamide, isocyanate or the like; and resins such as polyester resins, unsaturated polyester resins, silicone resins, urethane resins, polyamide resins, polyimide resins and fluororesins. Resins such as acrylic resins obtained by polymerization or copolymerization of an acrylic or methacrylic ester may also be used. Mixtures and reaction products of these resins may also be included.

As a method of forming the second overcoat layer, generally a precursor unreacted compound of a resin to be coated or a coating fluid in the form of its dilute solution, emulsion or colloid suspension in a solvent is applied by a process such as spray coating, curtain coating, dip coating, wire bar coating, applicator coating, spin coating, roll coating, electrodeposition coating or brush coating, and the coating film thus formed is then dried to remove the solvent, and optionally subjected to a cure reaction, thereby forming the second overcoat layer.

When the second overcoat layer is formed, as with the case where the first overcoat layer is formed as described above, cissing of the coating fluid may occur according to its compatibility with the materials for the formation of the first overcoat layer serving as an undercoating. In order to prevent the cissing, it is effective to subject the surface of the first overcoat layer to a cleaning treatment prior to the formation of the second overcoat layer. As an example of a method for the cleaning treatment suitably used at this time, may be mentioned a method in which the surface of the first overcoat layer on the base material is cleaned with oxygen plasma or ozone generated by ultraviolet-light irradiation in an oxygen-containing gas in common with the case where the first overcoat layer is formed.

The coating thickness of the second overcoat layer is preferably within a range of from 0.1 to 50 μm, more preferably from 1 to 30 μm in terms of the thickness after the drying or curing. If the coating thickness is thinner than 0.1 μm, it is difficult to completely cover a necessary part of the first overcoat layer due to irregularities of the dye-receiving layer and first overcoat layer and influence of foreign matter contained upon the formation of the respective layers, so that percent occurrence in defective coating becomes high. In addition, necessary mechanical strength cannot be achieved. When an ultraviolet absorbent and a mildew-proofing agent, which will be described subsequently, are contained in the second overcoat layer, their contents must be increased for the purpose of developing the effects of such agents. Therefore, it is more difficult to obtain the properties required of the second overcoat layer, such as mechanical strength. If the coating thickness of the second overcoat layer is made thicker than the above upper limit on the other hand, a further merit as to the properties can be scarcely obtained, leading to an economical loss. Peeling or cracking may occur in some cases due to shrinkage of a coating film when the coating film is cured upon the formation of the second overcoat layer. Therefore, such a too thin or thick coating thickness is not preferable.

In the present invention, it is preferable to contain an ultraviolet absorbent and/or an ultraviolet screening agent in the second overcoat layer. As a result, the light fastness of the disperse dyes, which form an image, is improved, and deterioration by yellowing of the dye-receiving layer and second overcoat layer themselves is prevented, thereby achieving good long-term stability of the image. When an image is formed on a base material used in a bathroom or the like, it is preferable to further contain a mildew-proofing agent in the second overcoat layer.

The ultraviolet absorbent used in the present invention means an agent which absorbs rays having a wavelength (300 to 450 nm) of high energy level in an ultraviolet region and discharges the rays as thermal energy, and acts to prevent the discoloration and fading of the resulting printed image by ultraviolet rays in sunlight and/or illumination light.

When such an ultraviolet absorbent is added into the second overcoat layer in the present invention, it is preferable to add it within limits not impeding the transparency of the second overcoat layer and use it in an amount ranging from 0.1 to 10% by weight based on the weight of the materials for the formation of the second overcoat layer. If the amount of the ultraviolet absorbent to be used is less than the above lower limit, the effect of improving the light fastness of the resulting image becomes insufficient. If it is used in an amount exceeding the above upper limit on the other hand, the film-forming property and film properties of the second overcoat layer are adversely affected. It is hence not preferable to add such an agent in any amount outside the above range.

As the ultraviolet absorbent used in the present invention, there may be used any conventionally-known agents, for example, salicylate-type, benzophenone-type, benzotriazole-type, acrylonitrile-type, hindered amine-type and metal complex type ultraviolet absorbents. Preferable examples thereof include phenyl salicylate, p-tert-butylphenyl salicylate, p-octyl salicylate, 2-hydroxybenzophenone, 2,4-dihydroxybenzophenone, 2-hydroxy-4-methoxy-benzophenone, 2-hydroxy-4-methoxy-2'-carboxy-benzophenone, 2-hydroxy-4-methoxy-5-sulfobenzophenone trihydrate, 2-hydroxy-4-octoxybenzophenone, 2-hydroxy-4-octadecyloxy-benzophenone, 2-hydroxy-4-methoxybenzo-phenone-5-sulfonic acid, 2-hydroxy-4-dodecyloxybenzo-phenone, 2,2'-dihydroxy-4-methoxybenzophenone, 2,2'-dihydroxy-4,4'-dimethoxy-benzophenone, 2,2', 4,4'-tetrahydroxybenzophenone, sodium 2,2'-dihydroxy-4,4'-dimethoxy-5-sulfobenzophenone, 5-chloro-2-hydroxybenzo-phenone, 2-(2'-hydroxy-4'-octoxyphenyl) benzotriazole, 2-(2'-hydroxy-3'-t-butyl-5'-methylphenyl)-5-chlorobenzo-triazole, 2-(2'-hydroxy-3'-tert-butyl-5'-octylphenyl propionato)-5-chlorobenzo-triazole, (5'-octylphenyl propionato)-5-chlorobenzo-triazole, 2-(2'-hydroxy-5'-methylphenyl)benzotriazole, 2-(2'-hydroxy-5'-tert-butylphenyl)benzotriazole, 2-(2-hydroxy-3',5-di-tert-butylphenyl)benzotriazole, 2-(2'-hydroxy-3',5-di-tert-butylphenyl)-5-chlorobenzotriazole, 2-(2'-hydroxy-3',5-tert-amylphenyl)benzotriazole, 2-[2-hydroxy-3,5-di(2,2-dimethylbenzene)-phenyl]-2H-benzotriazole, 2-ethylhexyl-2-cyano-3,3'-diphenyl acrylate, ethyl-2-cyano-3,3'-diphenyl acrylate, nickel bis(octylphenyl) sulfide, nickel [2,2'-thiobis (4-tert-octylphenolate)]-n-butylamine, polyethylene glycol 3-[3-(2H-benzotriazol)-2-yl-5-tert-butyl-4-hydroxyphenyl]-propionate monoester and diester, nickel complex of 3,5-di-tert-butyl-4-hydroxybenzyl-phosphoric acid monoethylate, nickel dibutyldithiocarbamate, resorcinol monobenzoate, hexamethylphosphoryltriamide, 2,4,5-trihydroxybutyl-phenone, di-p-octylphenyl terephthalate, di-p-n-nonylphenyl isophthalate, hindered amines such as bis(1,2, 2,6-tetramethyl-4-piperidine) 2-(3,5-di-tert-butyl-4-hydroxybenzyl)-2-n-butylmalonate, and comonomers introduced in copolymers together with other monomers, such as 2-oxy-4-(2-oxy-3-methacryloxy)propoxy-benzophenone and ethyl diphenylmethylenecyanoacetate.

The ultraviolet screening agent used in the present invention means an agent which blocks rays having a wavelength in an ultraviolet region, and acts to prevent the discoloration and fading of the resulting printed image by ultraviolet rays.

When such an ultraviolet screening agent is added into the second overcoat layer in the present invention, it is preferable to add it within limits not impeding the transparency of the second overcoat layer and use it in an amount ranging from 0.1 to 30% by weight based on the weight of the materials for the formation of the second overcoat layer. If the amount of the ultraviolet screening agent to be used is less than the above lower limit, the effect of improving the light fastness of the resulting image becomes insufficient. If it is used in an amount exceeding the above upper limit on the other hand, no effects according to the excessive amount can be brought about, and moreover opacity increases, so that appreciation of the resulting image is impeded. In addition, the film-forming property and film properties of the second overcoat layer may be adversely affected in some cases. It is hence not preferable to add such an agent in any amount outside the above range. Examples of the ultraviolet screening agent used in the present invention include silica, talc, mica and cerium oxide.

As the mildew-proofing agent preferably used in the present invention, there may be used any conventionally-known agents. When such a mildew-proofing agent is added into the second overcoat layer, it is preferable for the agent to account for 0.01 to 10% by weight of the weight of the second overcoat layer. If the amount of the mildew-proofing agent to be used is less than 0.01% by weight, its effect becomes insufficient. If it is used in an amount exceeding 10% by weight on the other hand, the mildew-proofing property can not be improved correspondingly to the used amount. It is hence not preferable to add such an agent in any amount outside the above range. Since the effects of mildew-proofing agents vary according to the kinds of fungi, it is also effective to use two or more mildew-proofing agents in an amount within the above range.

Preferable examples of such mildew-proofing agents used at this time include benzoic acid, sorbic acid, p-hydroxybenzoic esters, dihydroxyacetic acid, propionic acid and salts thereof, as well as diphenyl, o-phenyl-phenol, copper 8-quinolinolate, PCP, PCP-Na, p-chloro-m-xylenol, dihydroxyethylamine pentachlorophenol, 4-chloro-2-phenylphenol, N-(trichloromethylthio)phthalamide, N,N-dimethyl-N'-phenyl(N'-fluorodichloromethylthio) sulfamide, N-(trichloromethylthio)-4-cyclohexene-1,2-dicarboxyimide, 2,4,5,6-tetrachloro-isophthalonitrile, bis (tri-n-butyltin) oxide, tributyltin laurate, 10,10'-oxybisphenoxyarsine and thiabendazole.

In the step of forming the laminated overcoat layer, the coating fluids separately containing the resins, which are materials for forming the above first and/or second overcoat layers, are applied, and the resins are then cured as needed, thereby forming the laminated overcoat layer. Curing method of the resins vary according to resins used and include heat curing and exposure to radiation having activation energy. In each case, it is preferable to perform the curing at a temperature lower than the heating temperature upon the transfer of the disperse dye in the ink because the image formed with the disperse dye is adversely affected if the temperature upon the curing reaction is too high. For example, it is preferable to heat it at about 80 to 180° C. for about 5 to 60 minutes. With respect to the method by the exposure to the radiation having activation energy, it is preferable to perform the exposure at an exposure rate of about 50 to 3,000 mJ/cm$^2$ using an ultra-high pressure mercury lamp The present invention will hereinafter be described more specifically by the following Examples and Comparative Examples. Incidentally, all designations of "part" or "parts" as will be used in the following examples mean part or parts by weight unless expressly noted.

EXAMPLE 1

First, an intermediate printed article was obtained in the following manner. In this example, Inks A to D having the following compositions, respectively, were used.

[Ink A]

Disperse dye (C.I. Disperse Yellow 76) 5 parts

Anionic surfactant (Ionet D-2, trade 4 parts name; product of Sanyo Chemical Industries, Ltd.)

Diethylene glycol 15 parts

Triethylene glycol monomethyl ether 10 parts

Water 70 parts.

After all the above components were placed in a ball mill made of alumina to prepare a mixture, and the mixture was dispersed for about 36 hours in the ball mill, and the pH of the dispersion was adjusted to 7.6 with lithium hydroxide, followed by further dispersing it for 2 hours in a homogenizer. Thereafter, coarse particles were removed by centrifugation, thereby obtaining a water-based Ink A.

[Ink B]

Disperse dye (C.I. Disperse Yellow 79) 3 parts

Disperse dye (C.I. Disperse Blue 60) 3 parts

Anionic surfactant (Ionet D-2, trade 5.5 parts name; product of Sanyo Chemical Industries, Ltd.)

Ethylene glycol 25 parts

Glycerol 5 parts 1,3-Dimethylimidazolinone 5 parts

Water 60 parts.

A water-based Ink B was obtained from the above components in the same manner as Ink A.

[Ink C]

Disperse dye (C.I. Disperse Yellow 56) 3 parts

Anionic surfactant (Nikkol OPT-100s, 1.5 parts trade name; product of Nikko Chemicals Co., Ltd.)

Nonionic surfactant (Emulgen 911, 0.2 parts trade name; product of Kao Corporation)

Isopropyl alcohol 0.5 parts

Polyethylene glycol 5 parts

Water 75 parts.

After all the above components were placed in a ball mill made of alumina to prepare a mixture, and the mixture was dispersed for about 40 hours in the ball mill, and the pH of the dispersion was adjusted to 7.4 with lithium hydroxide, followed by further dispersing it for 2 hours. Thereafter, coarse particles having a particle size of 5 $\mu$m or greater were removed by a Fluoropore Filter FP-500 (trade name; product of Sumitomo Electric Industries, Ltd.), thereby obtaining a water-based Ink C.

[Ink D]

A water-based Ink D was obtained in exactly the same manner as in Ink A except that a disperse dye, C.I. Disperse Red 227 was used in place of the disperse dye, C.I. Disperse Yellow 76 in Ink A.

Inks A to D thus obtained were charged in ink tanks of a BJC-600J (trade name; ink-jet printer of bubble jet system; manufactured by Canon Inc.), and an image was formed on PB paper (trade name; plain paper; product of Canon Inc.), thereby obtaining-an image-printing sheet. The image formed was such that a pattern of a bird was printed on a white ground, and the remaining white portion was about 70% in terms of area.

A dye-receiving layer was then formed on a base material for forming an image on the base material using the image-printing sheet obtained above. The base material used at this time was a white tile of 110 mm square. As a material for the formation of the dye-receiving layer, a mixture having the following composition was used.

Sericol SP-3100 (trade name; urethane 100 parts resin; product of Teikoku Ink Mfg. Co., Ltd.)

Sericol 210 (trade name; isocyanate; 13 parts product of Teikoku Ink Mfg. Co., Ltd.)

n-Butyl acetate (diluent solvent; 40 parts. product of Kishida Chemical Co., Ltd.)

The mixture composed of the above components was sprayed on the surface of the white tile by a sprayer so as to give a dry coating thickness of about 10 $\mu$m. After the coating, the coating film was heated for 30 minutes at 90° C. and then for 30 minutes at 150° C., thereby removing the solvent and conducting a cure reaction.

The image-formed surface of the image-printing sheet described above was brought into close contact with the dye-receiving layer formed on the white tile and treated for 6 minutes at a pressure of 0.3 kg/cm$^2$ and a temperature of 200° C., thereby transferring the disperse dyes to the dye-receiving layer. After the transfer treatment, the printing sheet was separated from the surface of the dye-receiving layer on the base material, thereby obtaining an intermediate printed article. The resultant image of the intermediate printed article was clear and sufficient in color density, and was such that the original image was faithfully reproduced.

The surface of the intermediate printed article thus obtained was subjected to an ultraviolet light/ozone treatment for 30 seconds to clean it. An Eye UV/$O_3$ cleaning machine (Model: OC-253) manufactured by IWASAKI ELECTRIC CO., LTD. was used as a cleaner.

A first overcoat layer was formed on the surface of the intermediate printed article cleaned in the above-described manner in the following manner. As a material for the formation of the first overcoat layer, a coating fluid having the following composition was used. As a process for the formation, the coating fluid composed of the following components was first applied to the surface of the intermediate printed article by brush coating to form a coating film.

NK Ester A-400 (trade name; 25 parts polyethylene glycol #400 diacrylate; product of Shin-Nakamura Chemical Co., Ltd.)

Irgacure 2959 (trade name; ultraviolet 5 parts curing agent; product of CIBA-GEIGY (Japan) Limited)

Water 70 parts.

After the coating film was heated at 80° C. for 30 minutes to dry it, the resultant first overcoat layer was exposed to radiation having an intensity of 1 J/cm$^2$ from an extra-high pressure mercury lamp to cure the resin. The thickness of the first overcoat layer after the cure was 3 $\mu$m. The surface of the resultant first overcoat layer was cleaned by the same ultraviolet light/ozone treatment as described above.

A second overcoat layer was then formed on the first overcoat layer formed in the above-described manner. As a material for the formation of the second overcoat layer, a coating fluid having the following composition was used. This coating fluid was applied by spray coating to form a coating film.

ZPP-N-1000 (trade name; phosphazene 70 parts type methacrylate; product of Kyoeisha Chemical Co., Ltd.)

NK Ester A-9530 (trade name; dipenta- 30 parts erythritol polyacrylate; product of Shin-Nakamura Chemical Co., Ltd.)

Irgacure 184 (trade name; ultraviolet 5 parts curing agent; product of CIBA-GEIGY (Japan) Limited)

Tinuvin 400 (trade name; ultraviolet 3 parts absorbent; product of CIBA-GEIGY (Japan) Limited)

Tinuvin 123 (trade name; hindered 2 parts amine; product of CIBA-GEIGY (Japan) Limited)

Cellosolve acetate (dilute solvent; 200 parts product of Kishida Chemical Co., Ltd.)

Calcium propionate (mildew-proofing 0.3 parts. agent; product of Ueno Pharmaceuticals Industry, Ltd.)

After the coating film was then heated at 80° C. for 30 minutes to dry it, the resultant second overcoat layer was exposed to radiation having an intensity of 1 J/cm$^2$ from the extra-high pressure mercury lamp to cure the resin, thereby producing a printed article. The thickness of the second overcoat layer after the cure was 16 $\mu$m.

No cissing of the coating fluid was observed even upon the formation of each of the overcoat layers, and the coating was successfully effected. The reflection density of the resultant printed article was measured at its white portion and found to be 0.06 after the formation of the overcoat layers. Rise in reflection density after the formation of the overcoat layers was only 0.01, and the resulting image was hence clear and beautiful.

EXAMPLE 2

An intermediate printed article was produced in the same manner as in Example 1 except that white plate glass of 100 by 100 by 1.1 millimeters in dimensions was used as a base material. The surface of the intermediate printed article thus obtained was subjected to a washing treatment with oxygen plasma under conditions described below to clean the surface. An apparatus used at this time was DES-125A (trade name) manufactured by Plasma Systems Co., Ltd. The cleaning treatment was performed under conditions of RF power of 0.5 kW, a degree of vacuum of 1.2 Torr, an oxygen quantity of 300 SccM and treating time of 30 seconds.

A first overcoat layer was then formed on the surface of the intermediate printed article. As a material for the formation of the first overcoat layer, Voncoat 9450 (trade name, acrylic-styrene type aqueous emulsion, product of Dainippon Ink & Chemicals, Incorporated), which was an aqueous emulsion, was used. This aqueous emulsion was applied to the surface of the intermediate printed article by brush coating, and the coating film formed was then heated at 80° C. for 30 minutes to dry it. The thickness of the first overcoat layer after the drying was 1 $\mu$m.

A second overcoat layer was then formed on the thus-obtained first overcoat layer on the base material. The second overcoat layer was formed by using a coating fluid having the following composition and applying it to the first overcoat layer by spray coating.

BK-80 (trade name; acrylic polymer; 50 parts product of Mitsubishi Rayon Co., Ltd.)

NK Ester A-9530 (trade name; dipenta- 25 parts erythritol polyacrylate; product of Shin-Nakamura Chemical Co., Ltd.)

Arronix M-315 (trade name, highly hard 25 parts acrylic monomer; product of Toagosei Chemical Industry Co., Ltd.)

Irgacure 651 (trade name; ultraviolet 5 parts curing agent; product of CIBA-GEIGY (Japan) Limited)

Tinuvin 400 (trade name; ultraviolet 3 parts absorbent; product of CIBA-GEIGY (Japan) Limited)

Tinuvin 123 (trade name; hindered 2 parts amine; product of CIBA-GEIGY (Japan) Limited)

Cellosolve acetate (dilute solvent; 200 parts product of Kishida Chemical Co., Ltd.)

Sodium dehydroacetate (mildew-proofing 0.4 parts, agent; product of The Nippon Synthetic Chemical Industry Co., Ltd.)

After the coating film composed of the materials for the formation of the second overcoat layer was then heated at 80° C. for 30 minutes to dry it, the resultant second overcoat layer was exposed to radiation having an intensity of 1 J/cm$^2$ from an extra-high pressure mercury lamp to cure the resin, thereby producing a printed article. The thickness of the second overcoat layer after the cure was 18 $\mu$m.

No cissing of the coating fluid was observed even upon the formation of each of the overcoat layers, and the coating was successfully effected. The reflection density of the resultant printed article was measured at its white portion and found to be 0.05 after the formation of the overcoat layers. Rise in reflection density after the formation of the overcoat layers was only 0.01, and the resulting image was hence clear and beautiful.

EXAMPLE 3

An intermediate printed article was produced in the same manner as in Example 1 except that a coating fluid having the following composition was used as a material for the formation of a dye-receiving layer to be formed on a base material. The surface of the intermediate printed article was cleaned in the same manner as in Example 1.

Desmophen 651-67 (trade name; 162 parts branched polyester; product of Sumitomo Bayer Urethane Co., Ltd.)

Sumidur N75 (trade name; aliphatic 100 parts polyisocyanate; product of Sumitomo Bayer Urethane Co., Ltd.)

n-Butyl acetate (diluent solvent; 100 parts. product of Kishida Chemical Co., Ltd.)

A first overcoat layer was then formed on the surface of the intermediate printed article obtained above. The formation of the first overcoat layer was performed in accordance with the following process. As a material for the formation of the first overcoat layer, Primal B-88 (trade name, acrylic type aqueous emulsion, product of Rohm & Haas Co.), which was an aqueous emulsion, was used. This aqueous emulsion was applied to the surface of the intermediate printed article by brush coating to form a coating film, and the coating film thus formed was then heated at 90° C. for 30 minutes to dry it. The thickness of the first overcoat layer after the drying was 5 $\mu$m.

A second overcoat layer was then formed on the first overcoat layer thus formed. As a process for the formation of the second overcoat layer, the following composition was first applied to the first overcoat layer by spray coating to form a coating film.

Glassca HPC7001 (trade name; silica 90 parts type resin; product of Japan Synthetic Rubber Co., Ltd.)

Glassca 402H (trade name; curing 10 parts agent for Glassca; product of Japan Synthetic Rubber Co., Ltd.)

SERIGUARD S-3018 (trade name; 2.2 parts ultraviolet screening agent; product of Nippon Inorganic Chemical Co., Ltd.; 10% by weight based on the true weight of Glassca)

Sodium dehydroacetate (mildew-proofing 0.4 parts. agent; product of The Nippon Synthetic Chemical Industry Co., Ltd.)

After the coating film was then heated at 150° C. for 10 minutes to cure the resin, thereby producing a printed article. The thickness of the second overcoat layer after the cure was 8 $\mu$m. No cissing of the coating fluid was observed even upon the formation of each of the overcoat layers, and the coating was successfully effected. The reflection density of the resultant printed article was measured at its white portion and found to be 0.05 after the formation of the overcoat layers. Rise in reflection density after the formation of the overcoat layers was only 0.01, and the resulting image was hence clear and beautiful.

EXAMPLE 4

An intermediate printed article was produced in the same manner as in Example 1, and a coating fluid having the following composition composed of materials for the formation of a first overcoat layer was applied to the surface of the intermediate printed article by spray coating.

Denacol EX-521 (trade name; 10 parts polyglycerol polyglycidyl ether; product of Nagase Chemicals, Ltd.)

Tetramethylammonium chloride (curing 1 part agent for epoxy; product of Kishida Chemical Co., Ltd.)

Water 99 parts.

After the application of the first overcoat layer, the first overcoat layer was heated at 80° C. for 20 minutes and at 150° C. for 10 minutes to cure the resin. The thickness of the first overcoat layer after the cure was 5 μm. Incidentally, the surfaces of the intermediate printed article and first overcoat layer were cleaned by the same method as in Example 2.

The following composition, which was a material for the formation of a second overcoat layer, was then applied to the first overcoat layer by spray coating to form a coating film.

Glassca HPC7002 (trade name; silica 75 parts type resin; product of Japan Synthetic Rubber Co., Ltd.)

Glassca 402H (trade name; curing 25 parts agent for Glassca; product of Japan Synthetic Rubber Co., Ltd.)

Tinuvin 900 (trade name; ultraviolet 0.66 parts absorbent; product of CIBA-GEIGY (Japan) Limited; 3% by weight based on the true weight of Glassca)

Tinuvin 144 (trade name; hindered 0.44 parts amine; product of CIBA-GEIGY (Japan) Limited)

Methyl ethyl ketone (dilute solvent; 30 parts product of Kishida Chemical Co., Ltd.)

Sodium dehydroacetate (mildew-proofing 0.4 parts. agent; product of The Nippon Synthetic Chemical Industry Co., Ltd.)

The coating film was then heated at 150° C. for 10 minutes to cure the resin, thereby forming the second overcoat layer to produce a printed article. The thickness of the second overcoat layer after the cure was 7 μm.

No cissing of the coating fluid was observed even upon the formation of each of the overcoat layers, and the coating was successfully effected. The reflection density of the resultant printed article was measured at its white portion and found to be 0.06 after the formation of the overcoat layers. Rise in reflection density after the formation of the overcoat layers was only 0.02, and the resulting image was hence clear and beautiful.

Comparative Example 1

A printed article was produced by producing an intermediate printed article in the same manner as in Example 1, the surface of the intermediate printed article was cleaned by the same method as in Example 1 and then only the same second overcoat layer was provided as that of Example 1 without providing the first overcoat layer.

Comparative Example 2

An intermediate printed article was produced in the same manner as in Example 1, and only the same first overcoat layer as that of Example 1 was provided without conducting the cleaning treatment of the surface of the intermediate printed article.

Comparative Example 3

A printed article was produced by producing an intermediate printed article in the same manner as in Example 2, the surface of the intermediate printed article was cleaned by the same method as in Example 2 and then only the same second overcoat layer was provided as that of Example 2 without providing the first overcoat layer.

Comparative Example 4

After producing an intermediate printed article in the same manner as in Example 1, a printed article was produced without providing first and second overcoat layers.

The printed articles obtained in the above-described examples and comparative examples were evaluated in accordance with the following evaluating methods. The results are shown in Table 1.

(1) Cissing of overcoat layers

Whether cissing occurred or not upon the formation of the overcoat layers was observed visually to rank each sample as "A" where no cissing was observed, or "B" where cissing was observed.

(2) Pencil hardness

The pencil hardness of each sample was measured by means of a pencil scratch tester for film recommended by JIS in accordance with the method of JIS K 5400. The pencil hardness was evaluated by the degree of scratches on the surface of the coating film in the following manner. Namely, a scratch test was conducted 5 times for each sample. When scratching on the surface was observed twice or more while the test was repeatedly performed 5 times, the pencil used in the test was changed to a pencil having a lead hardness lower by one rank to conduct the same test, whereby the hardness sign of a pencil used at the time the number of times of scratching decreased to less than 2 times was recorded as a pencil hardness of the coating film. Alternatively, when scratching was observed less than twice while the scratch test was repeatedly performed 5 times, the pencil used in the test was changed to a pencil having a lead hardness higher by one rank to conduct the same test, whereby the hardness sign of a pencil having a lead hardness lower by one rank than a pencil used at the time the number of times of scratching increased to twice or more was recorded as a pencil hardness of the coating film.

(3) Scratch resistance

The surface of each printed article sample was reciprocatorily rubbed 30 times with a brush for tile joint made of polypropylene (product of Azuma Kogyo K.K.) under a load of about 1 kg, and then visually observed as to whether scratches were received or not. The scratch resistance was ranked as "A" where no scratches were observed, or "B" where scratches were observed.

(4) Sharpness of image

Particular attention was paid to boundaries between an area in which an image was formed with disperse dyes and an area free of any image to observe as to whether the sharpness of the image was affected by the exudation of the dyes. The sharpness of the image was ranked as "B" where the exudation of the dyes was observed, or "A" where no exudation was observed.

(5) Light fastness

Each printed article sample was left over for 50 hours in a xenon arc fade-o-meter (Atlas C, trade name; 35 W, inner filter: quartz; outer filter: borosilicate) under conditions of 50° C. and 65% RH. The image density of a red solid print area of the sample was measured before and after the test to use, as an index to the light fastness, a percentage value obtained by dividing an image density after the test by an image density before the test. Namely, a greater value indicates better light fastness.

(6) Stain resistance

Each printed article sample was left over for 2 months with the sample stuck on a wall of a bathroom. The bathroom was used once a day. The stain resistance was ranked as "B" where appreciation of the image was impeded due to generation of mold or mildew, and/or the like, or "A" where no stains were observed.

(7) Evaluation result

The evaluation results as to the above evaluation items (1) to (6) are shown in Table 1. Besides, overall evaluation was conducted from these results to also show the results thereof in Table 1. Incidentally, "-" in the table means that no evaluation was conducted. With respect to Comparative Example 2, the evaluation was conducted as to an area in which no cissing was observed.

TABLE 1

| | Example | | | | Comp. Example | | | |
|---|---|---|---|---|---|---|---|---|
| | 1 | 2 | 3 | 4 | 1 | 2 | 3 | 4 |
| Cissing | A | A | A | A | A | B | A | — |
| Pencil hardness | 8H | 4H | 4H | 7H | 8H | H | 4H | H |
| Scratch resistance | A | A | A | A | A | B | A | B |
| Sharpness of image | A | A | A | A | B | A | B | A |
| Light fastness | 90 | 90 | 88 | 89 | 89 | 55 | 88 | 40 |
| Stain resistance | A | A | A | A | A | B | A | B |
| Overall evaluation | A | A | A | A | B | B | B | B |

According to the present invention, as described above, clear and high-color density images faithfully conforming to an original image can be formed on base materials such as pottery, glass, plastics and metals, which have no liquid ink absorbency. Besides, the printed articles obtained in accordance with the present invention have sufficient scratch resistance and resistance to marker and good light fastness and also can prevent growth of mildew or mold, so that they have excellent image properties satisfactorily fit for use in the open air and humid places. Therefore, there can be provided printed articles which can be used in various purposes. According to the present invention, a clear image can also be formed even in, particularly, an image-printed article in which its ground is exposed to a great extent, because the sharpness of edges at boundaries between dyes forming the image and the exposed portions of the ground is good. Even in this sense, printed articles excellent in general-purpose properties can be provided.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A process for forming an image on a base material, which comprises the steps of:

(1) ejecting a liquid ink containing a disperse dye as droplets according to predetermined information to form an image on an ink-absorbent sheet, thereby obtaining an image-printing sheet;

(2) bringing the image-printing sheet into close contact with a base material having a dye-receiving layer capable of receiving the disperse dye on its surface and a high heat resistance of at least 150° C., heating the image-printing sheet to transfer and diffuse the disperse dye on the image-printing sheet to and into the dye-receiving layer, and then separating the image-printing sheet from the base material, thereby obtaining an intermediate printed article; and (3) applying an aqueous coating fluid containing a substantially transparent resin to the transferred image on the intermediate printed article to provide a first overcoat layer and then applying a substantially transparent resin to the first overcoat layer to provide a second overcoat layer having a pencil hardness of 2H or harder as determined by the pencil scratch test in accordance with JIS K 5400.

2. The image forming process according to claim 1, wherein the base material is selected from the group consisting of ceramics, glass, plastics and metals.

3. The image forming process according to claim 1, wherein the droplets are ejected by an ink-jet printing method.

4. The image forming process according to claim 3, wherein the ink-jet printing method is of a type that thermal energy is applied to an ink to form droplets of the ink.

5. The image forming process according to claim 1, wherein the ink is a water-based ink.

6. The image forming process according to claim 1, wherein the ink contains water and a polyhydric alcohol.

7. The image forming process according to claim 1, wherein the disperse dye has a transfer temperature of at least 180° C.

8. The image forming process according to claim 1, wherein the ink-absorbent sheet is paper.

9. The image forming process according to claim 1, wherein the dye-receiving layer has a pencil hardness of H or harder as determined by a pencil scratch test in accordance with JIS K 5400.

10. The image forming process according to claim 1, wherein the first overcoat layer is formed by applying an aqueous solution or emulsion of a resin.

11. The image forming process according to claim 1, wherein the first overcoat layer has a thickness ranging from 0.1 to 5 $\mu$m.

12. The image forming process according to claim 1, wherein the second overcoat layer has a thickness ranging from 0.1 to 50 $\mu$m.

13. The image forming process according to claim 1, wherein the intermediate printed article has an image having an optical density, and after application of the first and second overcoat layers, a final image having an optical density is formed, and the optical density of the final image is increased by 0.5 or lower compared to the optical density of the image of the intermediate printed article.

14. The image forming process according to claim 1, wherein upon formation of the first overcoat layer, the second overcoat layer, or both the first and second overcoat layers, resins forming the layers are subjected to a curing treatment.

15. The image forming process according to claim 14, wherein the resins are cured by heating.

16. The image forming process according to claim 15, wherein the resins are cured at a temperature lower than a transfer temperature of the disperse dye.

17. The image forming process according to claim 14, wherein the resins are cured by exposure to radiation having activation energy.

18. The image forming process according to claim 1, wherein the second overcoat layer contains an ultraviolet absorbent, an ultraviolet screening agent, or both an ultraviolet absorbent and an ultraviolet screening agent.

19. The image forming process according to claim 1, wherein the second overcoat layer contains a mildew-proofing agent.

20. The image forming process according to claim 1, wherein the intermediate printed article has a surface, and the surface is subjected to a cleaning treatment prior to formation of the first overcoat layer.

21. The image forming process according to claim 1, wherein the first overcoat layer has a surface, and the surface is subjected to a cleaning treatment prior to formation of the second overcoat layer.

22. The image forming process according to claim 20, wherein the cleaning treatment is an ultraviolet light/ozone treatment or a treatment by oxygen plasma.

23. The image forming process according to claim 21, wherein the cleaning treatment is an ultraviolet light/ozone treatment or a treatment by oxygen plasma.

24. The image forming process according to claim 1, wherein the resin forming the first overcoat layer is a water-soluble resin or a water-dispersible resin.

25. The image forming process according to claim 24, wherein the water-soluble resin is selected from the group consisting of poly(meth)acrylic acid and salts thereof, polyvinyl alcohol, water-soluble cellulose derivatives, carboxymethyl cellulose, starch, polyacrylamide, polyvinyl pyrrolidone, acrylic acid-vinyl alcohol copolymers, pectin, glue, casein, polyethylene oxide and poly(vinyl methyl ether).

26. The image forming process according to claim 24, wherein the water-dispersible resin is selected from the group consisting of poly(meth)acrylic acid type resins, (meth)acrylate type resins, styrene-butadiene type resins, acrylonitrile-butadiene type resins, vinyl acetate type resins and vinyl chloride type resins.

27. A printed article formed by the process according to any one of claims 1 to 26.

* * * * *

UNITED STATES PATENT AND TRADEMARK OFFICE

CERTIFICATE OF CORRECTION

PATENT NO. : 6,000,793
DATED : December 14, 1999
INVENTOR(S) : Tadayoshi Inamoto It is certified that error appears in the above-identified patent and that said Letters Patent is hereby corrected as shown below:

Column 2,
Line 30, "has been" should read -- have been --.
Line 41, "very" should be deleted.
Line 49, "to use" should read -- for use --.

Column 3,
Line 14, "achieve" should read -- achieved --.

Column 4,
Line 3, "far" should be deleted.

Column 5,
Line 9, "dispersed" should read -- disperse --.

Column 6,
Line 9, "alkylnaphthalene-sulfonates" should read -- alkylnaphthalenesulfonates --.
Line 22, "are" should read -- is --.

Column 10,
Lines 63 and 64, "than" should read -- more than --.

Column 13,
Line 34, "Example" should read -- Examples --.

Column 15,
Line 13, "methoxybenzo-phenone" should read -- methoxybenzophenone --.
Line 14, "dodecyloxybenzo-phenone," should read -- dodecyloxybenzophenone, --.
Line 16, "dimethoxy-benzophenone," should read -- dimethoxybenzophenone, --.
Line 19, "hydroxybenzo-phenone," should read -- hydroxybenzophenone, --.
Lines 21, 22 and 23, "chlorobenzo-triazole," should read -- chlorobenzotriazole, --.
Line 25, "2- (2-hydroxy" should read -- 2- (2' -hydroxy --.

Column 16,
Line 45, "lamp" should read -- lamp. --.
Line 58, "4 parts" should be deleted.
Line 59, "Ltd.)" should read -- Ltd.) 4 parts --.
Line 64, "After all" should read -- All --.

UNITED STATES PATENT AND TRADEMARK OFFICE

CERTIFICATE OF CORRECTION

PATENT NO. : 6,000,793
DATED : December 14, 1999
INVENTOR(S) : Tadayoshi Inamoto It is certified that error appears in the above-identified patent and that said Letters Patent is hereby corrected as shown below:

Column 17,
Line 7, "5.5 parts" should be deleted.
Line 8, "Ltd.)" should read -- Ltd.) 5.5 parts --.
Line 18, "1.5 parts" should be deleted.
Line 19, "Ltd.)" should read -- Ltd.) 1.5 parts --.
Line 20, "0.2 parts" should be deleted.
Line 21, "Corporation)" should read -- Corporation) 0.2 parts --.
Line 25, "After all" should read -- All --.
Line 43, "obtaining-an" should read -- obtaining an --.
Line 54, "100 parts" should be deleted.
Line 55, "Ltd.)" should read -- Ltd.) 100 parts --.
Line 56, "13 parts" should be deleted.
Line 57, "Ltd.)" should read -- Ltd.) 13 parts --.
Line 58, "40 parts." should be deleted.
Line 59, "Ltd.)" should read -- Ltd.) 40 parts. --.

Column 18,
Line 23, "25 parts" should be deleted.
Line 25, "Ltd.)" should read -- Ltd.) 25 parts --.
Line 26, "5 parts" should be deleted.
Line 27, "Limited)" should read -- Limited) 5 parts --.
Line 42, "70 parts" should be deleted.
Line 43, "Ltd.)" should read -- Ltd.) 70 parts --.
Line 45, "30 parts" should be deleted.
Line 47, "Ltd.)" should read -- Ltd.) 30 parts --.
Line 48, "5 parts" should be deleted.
Line 49 "Limited)" should read -- Limited) 5 parts --.
Line 50, "3 parts" should be deleted.
Line 51, "Limited)" should read -- Limited) 3 parts --.
Line 52, "2 parts" should be deleted.
Line 53, "Limited)" should read -- Limited) 2 parts --.
Line 54, "200 parts" should be deleted.
Line 55, "Ltd.)" should read -- Ltd.) 200 parts --.
Line 57, "0.3 parts." should be deleted.
Line 58, "Ltd.)" should read -- Ltd.) 0.3 parts. --.

UNITED STATES PATENT AND TRADEMARK OFFICE

CERTIFICATE OF CORRECTION

PATENT NO. : 6,000,793
DATED : December 14, 1999
INVENTOR(S) : Tadayoshi Inamoto It is certified that error appears in the above-identified patent and that said Letters Patent is hereby corrected as shown below:

Column 19,
Line 35, "50 parts" should be deleted.
Line 36, "Ltd.)" should read -- Ltd.) 50 parts --.
Line 37, "dipenta-25 parts erythritol" should read -- dipentaerythritol --.
Line 39, Ltd.)" should read -- Ltd.) 25 parts --
Line 40, "25 parts" should be deleted.
Line 42, "Ltd.)" should read -- Ltd.) 25 parts --.
Line 43, "5 parts" should be deleted.
Line 44, "Limited)" should read -- Limited) 5 parts --.
Line 45, "3 parts" should be deleted.
Line 46, "Limited)" should read -- Limited) 3 parts --.
Line 47, "2 parts" should be deleted.
Line 48, "Limited)" should read -- Limited) 2 parts --.
Line 49, "200 parts" should be deleted.
Line 50, "Ltd.)" should read -- Ltd.) 200 parts --.
Line 52, "0.4 parts," should be deleted.
Line 54, "Ltd.)" should read -- Ltd.) 0.4 parts. --.

Column 20,
Line 11, "162 parts" should be deleted.
Line 13, "Ltd.)" should read -- Ltd.) 162 parts --.
Line 14, "100 parts" should be deleted.
Line 15, "Ltd.)" should read -- Ltd.) 100 parts --.
Line 17, "100 parts" should be deleted.
Line 18, "Ltd.)" should read -- Ltd.) 100 parts --.
Line 36, "90 parts" should be deleted.
Line 37, "Ltd.)" should read -- Ltd.) 90 parts --.
Line 38, "10 parts" should be deleted.
Line 39, "Ltd.)" should read -- Ltd.) 10 parts --.
Line 40, "2.2 parts" should be deleted.
Line 43, "Glassca)" should read -- Glassca) 2.2 parts --.
Line 44, "0.4 parts." should be deleted.
Line 46, "Ltd.)" should read -- "Ltd.) 0.4 parts. --.
Line 47, "After the" should read -- The --.
Line 66, "10 parts" should be deleted.
Line 67, "Ltd.)" should read -- Ltd.) 10 parts --.

UNITED STATES PATENT AND TRADEMARK OFFICE

CERTIFICATE OF CORRECTION

PATENT NO. : 6,000,793
DATED : December 14, 1999
INVENTOR(S) : Tadayoshi Inamoto It is certified that error appears in the above-identified patent and that said Letters Patent is hereby corrected as shown below:

Column 21,
Line 1, "1 part" should be deleted.
Line 2, "Ltd.)" should read -- Ltd.) 1 part --.
Line 13, "75 parts" should be deleted.
Line 14, "Ltd.)" should read -- Ltd.) 75 parts --.
Line 15, "25 parts" should be deleted.
Line 16, "Ltd.)" should read -- Ltd.) 25 parts --.
Line 17, "0.66 parts" should be deleted.
Line 19, "Glassca" should read -- Glassca) 0.66 parts --.
Line 21, "0.44 parts" should be deleted.
Line 22, "Limited)" should read -- Limited) 0.44 parts --.
Line 23, "30 parts" should be deleted.
Line 24, "Ltd.)" should read -- Ltd.) 30 parts --.
Line 25, "0.4 parts." should be deleted.
Line 27, "Ltd.)" should read -- Ltd.) 0.4 parts. --.

Column 24,
Line 2, "the pencil" should read -- a pencil --.

Signed and Sealed this

Nineteenth Day of March, 2002

*Attest:*

*Attesting Officer*

JAMES E. ROGAN
*Director of the United States Patent and Trademark Office*